United States Patent [19]

Dakof et al.

[11] Patent Number: 4,813,371

[45] Date of Patent: Mar. 21, 1989

[54] SKI WAXING APPARATUS

[75] Inventors: Michael Dakof; Gene Beebe, Both of Chico; Paul Fretwell, Oroville, all of Calif.

[73] Assignee: Hot Glide, Chico, Calif.

[21] Appl. No.: 115,522

[22] Filed: Nov. 2, 1987

[51] Int. Cl.[4] ..... B05C 1/02; B05C 11/04

[52] U.S. Cl. ..... 118/59; 118/103; 118/109; 118/110; 118/202; 118/220; 118/DIG. 9

[58] Field of Search ..... 118/72, 110, 103, 109, 118/100, 220, 202, DIG. 9, 59

[56] References Cited

U.S. PATENT DOCUMENTS

| | | | |
|---|---|---|---|
| 2,537,511 | 1/1951 | Coulombe | 118/72 X |
| 3,045,639 | 7/1962 | Kurlander et al. | 118/72 X |
| 3,788,270 | 1/1974 | Blair | 118/202 X |
| 4,407,218 | 10/1983 | Ordas | 118/72 X |
| 4,577,586 | 3/1986 | Morres et al. | 118/72 X |

*Primary Examiner*—John Mc Intosh

*Attorney, Agent, or Firm*—Mark C. Jacobs

[57] ABSTRACT

Apparatus for applying ski wax to the bottom of a ski comprising a pair of ski support tracks adapted to carry a ski thereon and align if for proper entry into a waxing area where heated wax is applied to the bottom of the ski while the ski is transported through the waxing area and buffing the same. In this manner, a ski is waxed and ready for skiiing.

20 Claims, 5 Drawing Sheets

5
6
30
59
32
71
70
68
74
66
67
64
69
129
101
102
105
103
23
131
33
122
121
72
75
62
24
36
65
84
61
123
37
48
49
39
118
22
56
45
46
63
60
19
57
47
112
41
21
55
54
115
113
111
50
25
119
20
156
10
160
15
1

SKI WAXING APPARATUS

BACKGROUND OF THE INVENTION

1. Field of the Invention

The invention relates to ski waxing apparatus; and, more particularly, to apparatus for automatically waxing the bottom of a ski.

2. Description of the Prior Art

It is well known that skis must be waxed to enable them to glide properly on snow surfaces. Generally, such waxing is carried out manually by the skier applying wax from a container or the like to the bottom of a ski. Such procedure is time consuming and messy and the skier may inadvertently miss areas on the ski bottom being waxed. Also, some places rent skis to the public and, as part of their service, may wax the skis before delivery to the customer. This procedure is thus labor intensive and costly to the ski rental operation.

There thus exists a need for apparatus for applying wax to the bottom of a ski automatically. Such apparatus can be made available at a ski lodge or the like, or at a ski rental store, and may be coin operated.

SUMMARY OF THE INVENTION

It is an object of this invention to provide apparatus for waxing the bottom of a ski.

It is a further object of this invention to carry out the foregoing object automatically wherein a ski is fed into the apparatus and conveyed therethrough while applying heated wax to the bottom, the ski exiting the apparatus automatically with a totally waxed and buffed bottom.

These and other objects are preferably accomplished by providing a pair of ski support tracks adapted to carry a ski thereon and align it for proper entry into a waxing area where heated wax is applied to the bottom of the ski while the ski is transported through the waxing area and buffing the same. In this manner, a ski is waxed and ready for skiing.

DESCRIPTION OF THE PREFERRED EMBODIMENT

Figure 1:
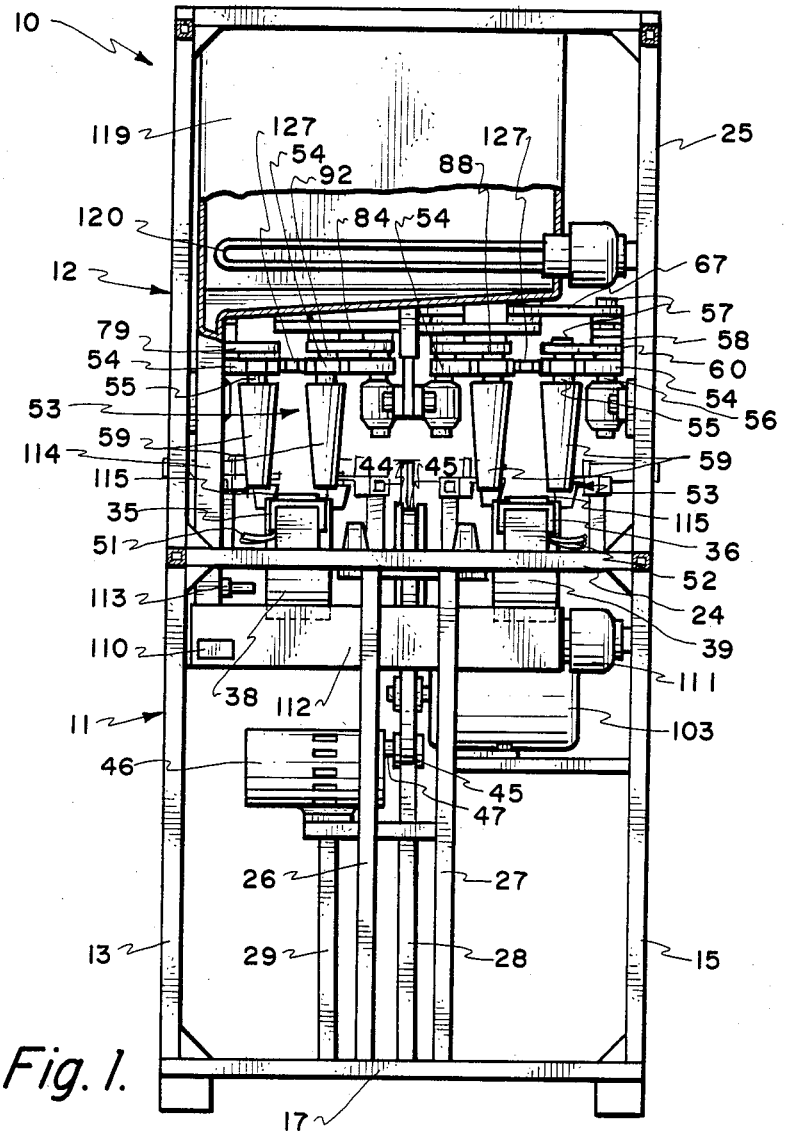
FIG. 1 is a front vertical view of ski waxing apparatus in accordance with the teachings of the invention taken along line 1—1 of FIG. 2.
Figure 3:
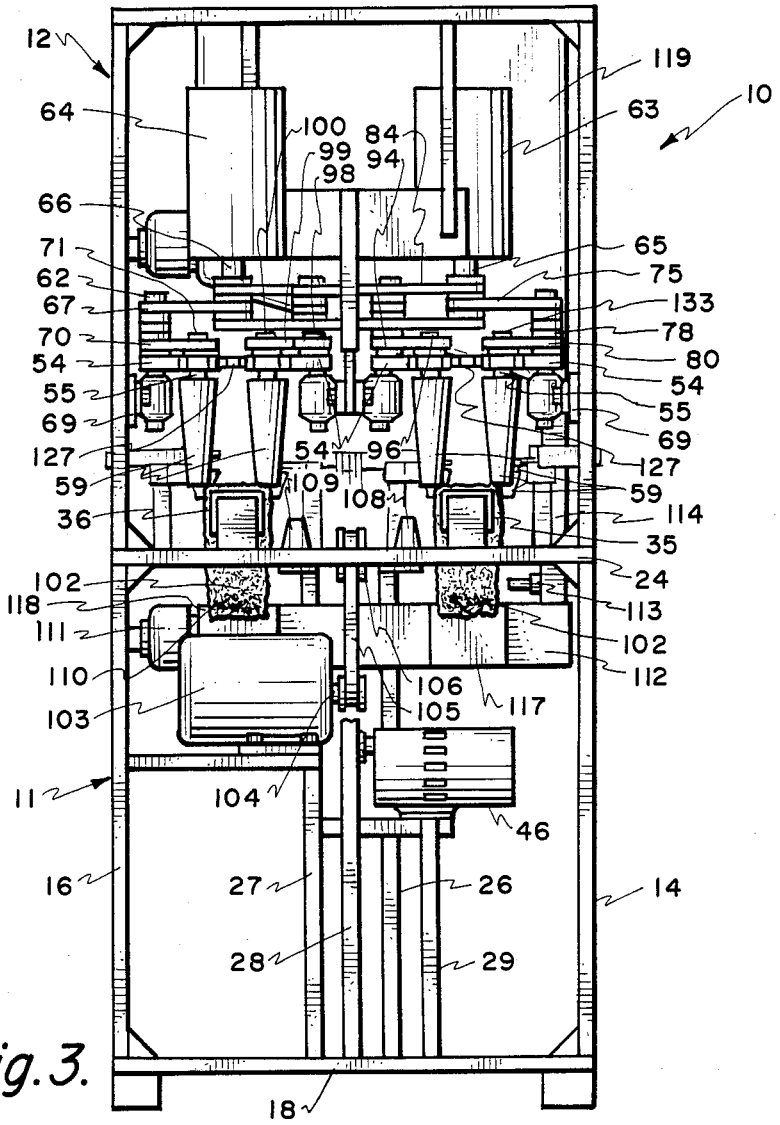
FIG. 3 is a rear elevational view of the apparatus of FIG. 1.

Referring now to FIG. 1 of the drawing, apparatus 10 is shown having a bottom support framework 11 and an upper main housing 12 mounted on framework 11. Any suitable framework may be used. As seen in FIGS. 1 and 3, framework 11 is comprised of a plurality, such as four, of upstanding corner supports 13 through 16 and front and rear supports 17, 18, respectively, connected to corner supports 13 to 16. Side supports 19, 20 interconnect the front and rear supports 17, 18 to the corner supports 13 to 16. A plurality of intermediate cross braces, such as braces 21 to 23, interconnect side supports 19, 20.

Figure 2:
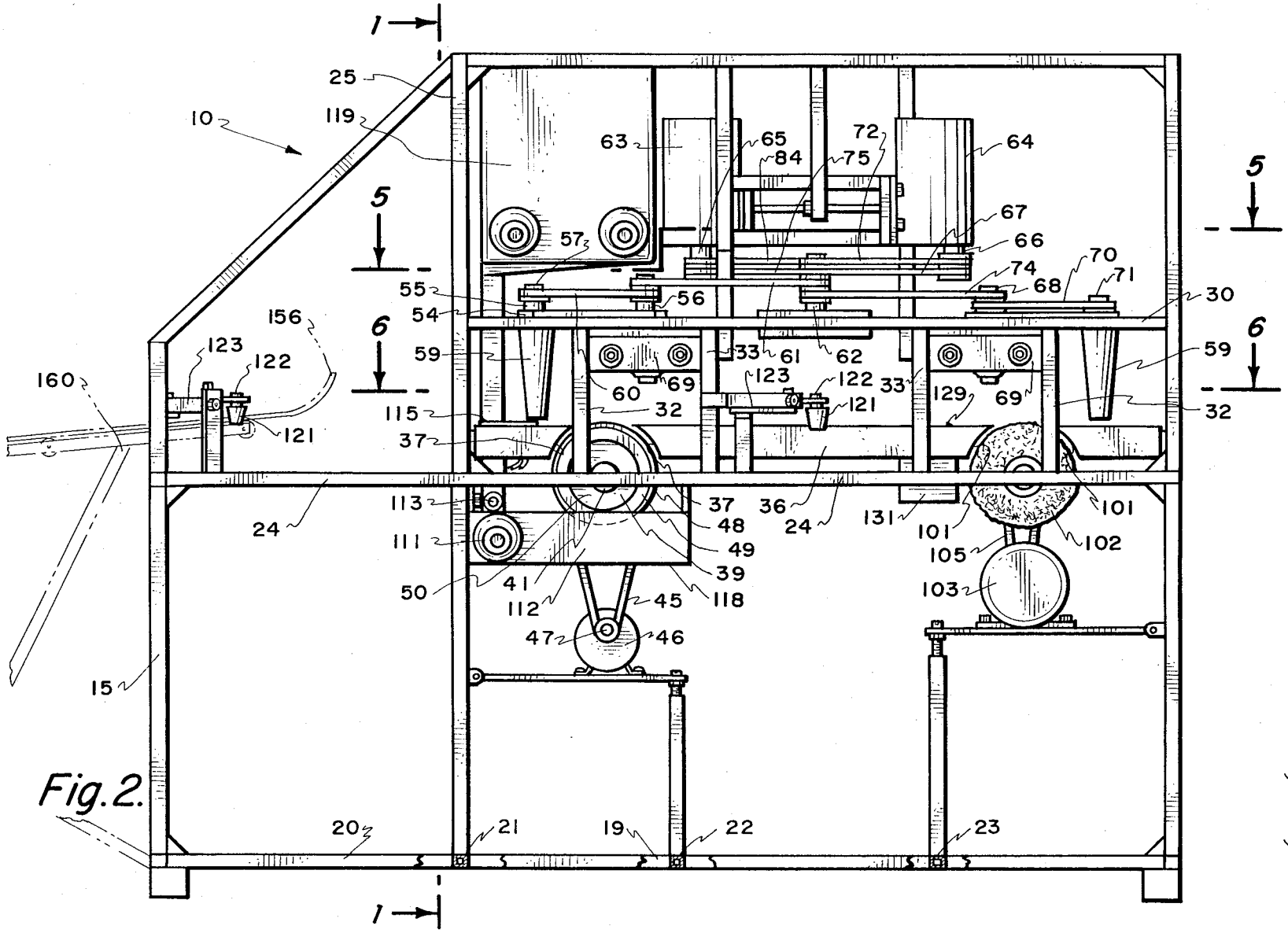
FIG. 2 is a right side elevational view of the apparatus of FIG. 1.
Figure 4:
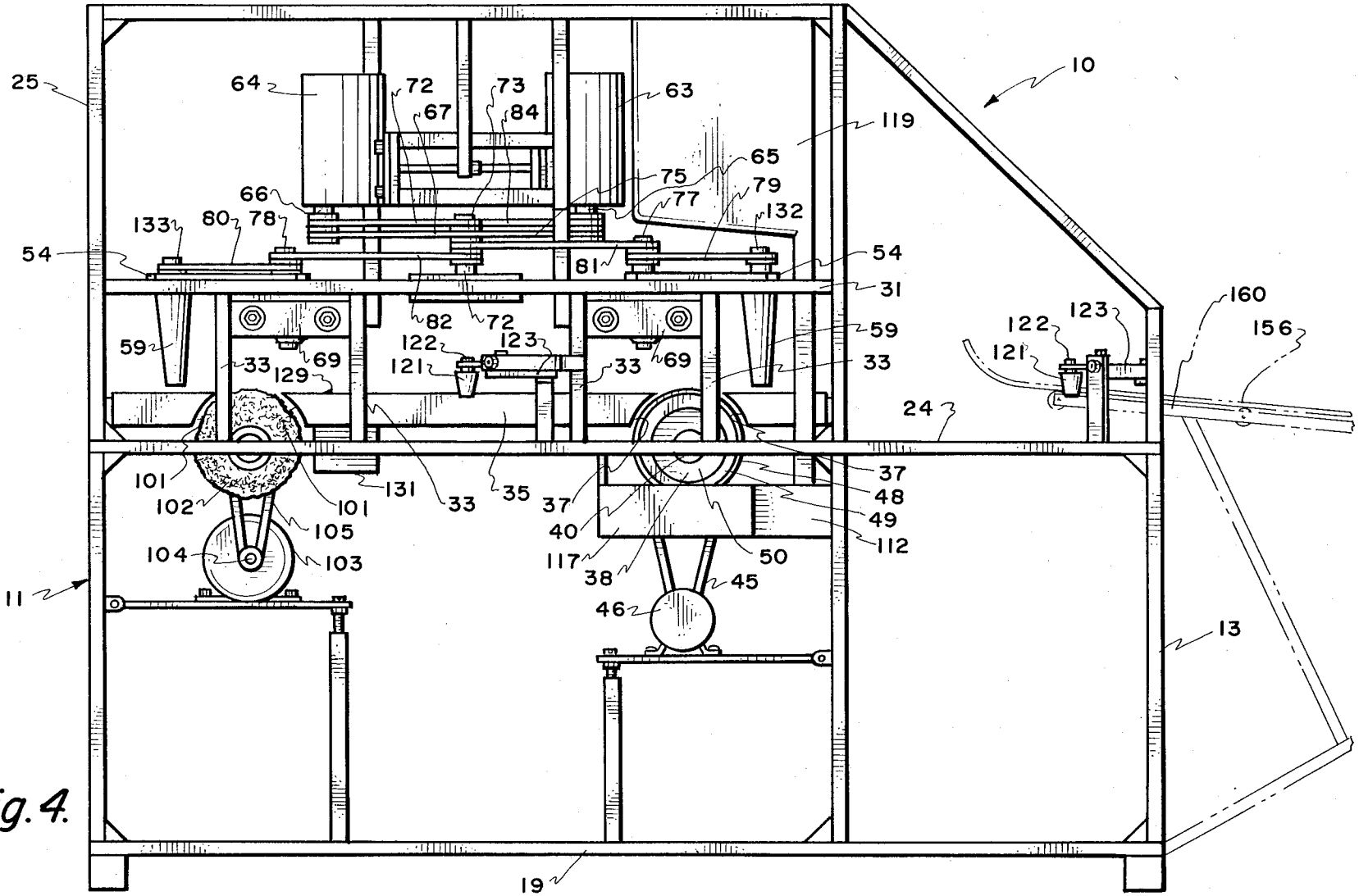
FIG. 4 is a left side elevational view of the apparatus of FIG. 1.

The upper ends of side supports 19, 20 are closed off by a rectangular frame 24 having main housing 12 mounted thereon. Housing 12 is shown as a box-like structure also having a box-like framework 25 mounted on top of frame 24 but spaced from the front thereof as shown. A plurality, such as four, of vertical bars 26 to 29 extend between braces 21, 22 and framework 25 as shown. As seen in FIGS. 2 and 4, each side of the framework 25 may be braced by horizontal braces 30, 31 and a plurality of four spaced vertical braces 32 (FIG. 2) and 33 (FIG. 4) interconnecting braces 30, 31 with the upper side bars of frame 24.

A pair of ski supports 35, 36 extend cross frame 24. These supports 35,36 may be elongated rectangular supports having an upper surface for receiving the bottom of a conventional ski thereon, as will be discussed.

As seen in FIGS. 2 and 4, a space 37 is provided in each ski support 35, 36 (see also FIG. 7) by cutting out a section thereof having curved sides as shown adapted to receive a rotating roller 38, 39 in each support 35, 36 as seen in FIGS. 2 and 4. Each roller 38, 39 includes a hub 40, 41, respectively, journaled for rotation on an axle 42, shown in FIG. 6, and being an axle common to each hub 40, 41. Axle 42 is coupled to a hubs 43 of a sheave 44 having a belt 45 thereon driven by the shaft 47 of motor 46 (FIG. 2).

Each roller 38, 39 (FIG. 3) has an outer resilient surface member 48 of polyurethane or the like carried by a metallic peripheral member 49 coupled to each hub 40 and 41. A conventional ring-type heater 50 is mounted to each roller 38, 39 adapted to heat member 49 and thus also heat resilient member 48. As seen in FIG. 1, suitable electric conduits 51, 52 couple heater 50 to control box 110 controlled by rotatable switch 111 as is well known in the art.

Looking at FIG. 1, a plurality of guide roller assemblies 53 (see also FIG. 5) are provided on apparatus 10. As seen in FIG. 1, two rows of such assemblies 53 are provided, one row associated with ski support 35 and one with ski support 36. Each row is comprised of a pair of front and back assemblies 53 (FIG. 5), the front and rear assemblies 53 of one support 35 being comprised of a pair of spaced assemblies 53 on each side of support 35. In like manner, the front and rear assemblies 53 of support 36 are also comprised of a pair of spaced assemblies 53 on each side of support 36.

Figure 5:
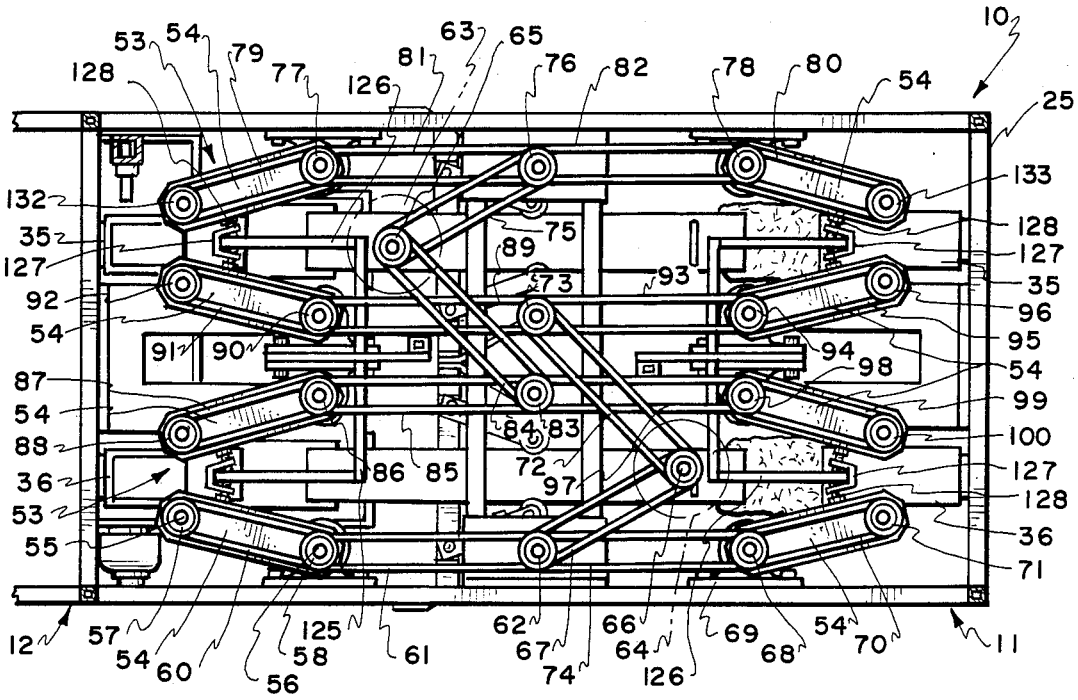
FIG. 5 is a plan view taken along line 5—5 of FIG. 2.

As seen in FIG. 1, each assembly 53 is comprised of an upper support bar 54 having a front rotatable axle 55 extending therethrough at the forward end thereof and journaled for rotation in bar 54 in any suitable manner. Suitable internal bearings, rollers, etc. may be provided. A rear axle 56 is journaled in the other end of bar 54. As seen, a single sheaved pulley 57 is fixedly secured to front axle 55 and a double sheaved pulley 58 is fixedly secured to rear axle 56. An elongated rubber coated wheel 59 is fixed to axle 55 below bar 54 for rotation therewith. These arrangements are also shown in FIG. 5. A belt 60 encircles the sheave of front pulley 57 and extends to and encircles the lower sheave of rear pulley 58. A similar belt 61 encircles the upper sheave of rear pulley 58 and extends to and encircles the middle sheave of a triple pulley 62 mounted for rotation on upper frame 24. As seen in FIGS. 2 and 4 a pair of motors 63, 64 are mounted on frame 24, each motor 63, 64 having a double pulley 65, 66, respectively, rotated thereby. Thus, a belt 67 encircles the lower sheave of triple pulley 62. Thus, rotation of pulley 66 via actuation of motor 64 rotates triple pulley 62 which in turn rotates double pulley 58 via belt 61. Double pulley 58 rotates single pulley 57 via belt 60. The lowermost sheave of triple pulley 62 receives a belt 74 (FIG. 2) which extends to the upper sheave of a double pulley 68 mounted on the rear support bar 69 (FIG. 5). The lower sheave of pulley 68 receives a belt 70 which extends to and rotates the sheave of single pulley 71 (FIGS. 2 and 5).

As seen in FIGS. 2 & 5, the upper sheave of the pulley 66 of motor 64 also drives a belt 72. This belt 72 drives a double pulley 73 mounted to frame 24 (FIGS. 4 and 5).

As seen in FIGS. 4 & 5, the pulley 65 of motor 63 has a belt 75 driving a triple pulley 76 which drives a pair of double pulleys 77, 78, respectively, via belts 81, 82, respectively. Belts 79, 80, from double pulleys 77, 78, respectively, drive single pulleys 132, 133, respectively.

A double pulley 83 is driven by belt 84 rotated by pulley 65 of motor 63. A belt 85 from double pulley 83 rotates double pulley 86 having belt 87 extending to single pulley 88. Belt 89 extends from double pulley 73 to a double pulley 90 having belt 91 driving single pulley 92. A like belt 93 extends from pulley 73 to a double pulley 94 driving single pulley 96 via belt 95. Finally, a belt 97 extends from double pulley 83 to a double pulley 98 driving single pulley 100 via belt 99. The axles, e.g. 55, of wheels or rollers 59 associated with pulleys 133, 96, 100, 71, 132, 92, 88 and 57 are mounted only to support bar 54 so that the free ends of these support bars swing freely. The axes at the other end of these support bars 54 are rotatably mounted to the framework and may have spring means (not shown) such as coil springs associated with the support bars so as to bias these support bars inwardly toward skis disposed on supports 35, 36. As seen in FIG. 5, an L-shaped spacer bar 125 is mounted to frame 24 having a leg 126 extending parallel to and between each set of wheel assemblies 53 at the front and back of each row thereof (i.e., associated with the pulley, assemblies 33, 96, 100, 71, 132, 92, 88 and 57 as heretofore discussed). Leg 126 has a U-shaped abutment member 127 at the terminal end thereof having a threaded adjustable spacer nut 128 threadably mounted in an aperture on each arm thereof adapted to abut against the side of adjacent support bars 54 to maintain each adjacent support bar in a predetermined spacing therebetween. Similar spacer bars 125 are provided in each row of each end thereof.

Figure 6:
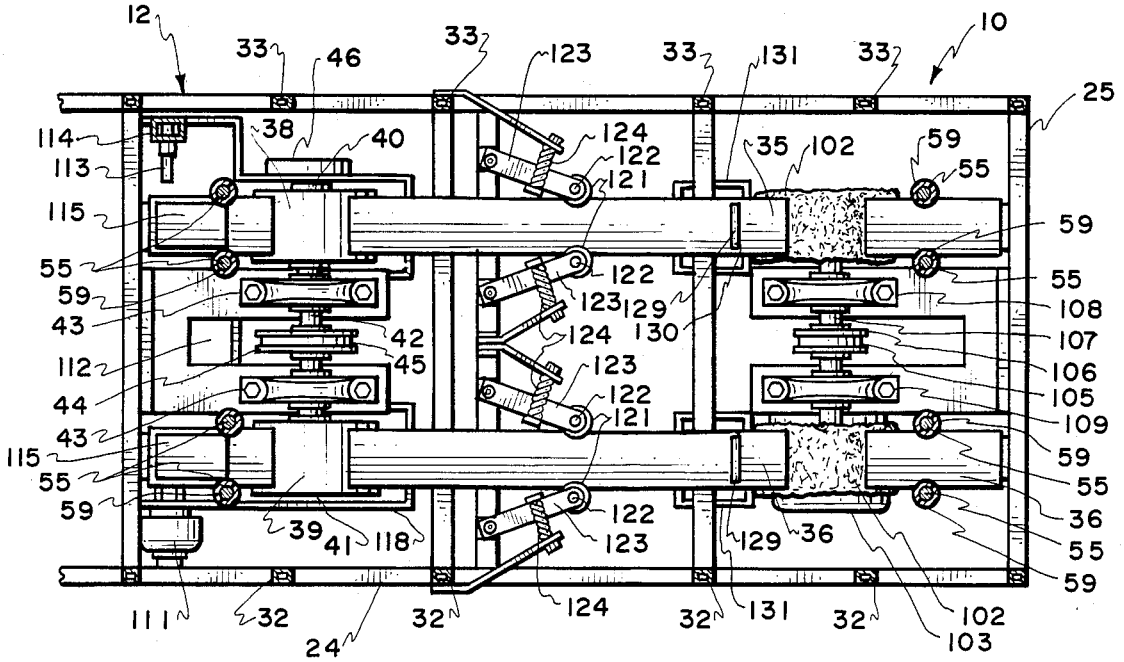
FIG. 6 is a plan view taken along line 6—6 of FIG. 2.

As seen in FIG. 6, a scraper blade 129 may be mounted in each ski support 35, 36 after rollers 38, 39 but before buffers 102 as will be discussed. Any suitable blade may be used and the blade 129 may either be fixed in position with its upper edge substantially flush with the upper surface of each support 35, 36 or spring biased so that it may extend slightly above the surface of each support 35, 36 so that it is depressed and springs back as the ski passes thereover so as to scrape off excess wax. The blade 129 may be removably mounted in a slot 130 in each support 35, 36, as shown, and angled, if desired. The blade 129 may be removable and excess wax may fall down into a tray or trough 131 under blade 129 and recovered, if desired.

As seen in FIGS. 2 & 4, a break or space 101 is provided in each ski support 35,36 similar to the space 37 heretofore described. A buffer 102 is mounted in each space 101 having a fabric outer surface for polishing each ski bottom after a wax application. As seen in FIGS. 2, 4 & 6, motor 103 is mounted in framework 11 below buffer 102, having a motor driven pulley 104 rotating a belt 105 extending to and about a wheel 106 fixed to a shaft 107 journaled for rotation in supports 108, 109. Shaft 107 is fixed to the hubs of each buffer 102 for rotating the same when motor 103 is activated. Suitable bearings and mounts may be provided. Buffer 102 may be of any suitable type, such as flannel buffers of the kind used in car washes comprised of a plurality of cloth layers or cloth fibers.

As seen in FIGS. 1 & 6, a wax holding tank 112 is disposed on framework 11 below rollers 38, 39 adapted to contain melted wax therein. This shows that, as rollers 38, 39 rotate within tank 112, wax is picked up by the rollers 38, 39. A conventional float actuated reed-type stainless steel valve 113 controls the input of heated wax from downspout 114, as will be discussed further, into the interior of tank 112.

As seen in FIGS. 2 and 4, conduits 51, 52 may also be coupled to suitable plate heaters 115 mounted flush in each ski support 35, 36 for heating the same. Suitable immersion-type heaters (not visible) are provided in tank 112 for heating the wax therein. Although the various parts may be mechanically operated, it is preferred to actuate the various elements electrically. The entire apparatus may be coin-operated and suitable components may be provided, any suitable materials being used. For example, the heaters for heating ski supports 35, 36 may be of the type manufactured by Ogden Co., under the Model No. OC 40-2-TL2. The ring heaters 50 may be of the type manufactured by Chromalox Co. under model No. 2363. The immersion heaters in tank 112 may be of the type manufactured by Thermo-Coil Co. under the designation ES-02-1011. Also, a suitable lead-in and lead-out table may be provided for leading into and out of apparatus 10. See infra.

The width of each ski support 35, 36 may be about 3 inches and about 4 feet in length. Suitable bearings, such as Teflon sleeved bearings, may be used. Rollers 38, 39 may be of aluminum with an outer coating of rubber. Ring heater 50 may be single heaters on each roller 38, 39 or one on each side thereof. Any suitable materials may be used throughout, such as aluminum and other metals. As indicated, the apparatus may be mechanically operated or electrically operated as by suitable switches, timers, temperature and speed controls, etc. Thus, the apparatus 10 may be entirely closed with ingress and outgress through slots in the front and back of the enclosure. The positioning of a ski on the ski support would activate the apparatus and transport the ski therethrough using suitable trip switches, photocells, etc.

The spacing between wheels 59 on each side of each ski support 35, 36 is generally related to the width of a conventional ski. Thus, in operation, a ski is placed, bottom down, on each ski support 35, 36 and the motors are actuated to rotate the various pulleys which in turn rotate the wheels 59. The wheels 59 engage the side edges of the skis and move them through apparatus 10 along each ski support 35, 36, as heretofore discussed, these wheels 59 are provided associated with pulleys 133, 96, 100, 71, 132, 92, 88 and 57 (FIG. 5) and thus move the skis through apparatus 10. Of course, only one ski at a time may be fed into apparatus 10 or both at once, if desired. The support bars 54 act as spring loaded swing arms to bias the wheels 59 against the edges of the skis to grip the same and draw them through apparatus 10 with abutment members 127 maintaining the spacing therebetween. The arrangement of motors and pulleys as heretofore discussed is such that the same motor drives the back right wheel assembly and the front left wheel assembly while the same motor drives the back left assembly and the front right assembly as seen in FIG. 5. Preferably wheels 59 are downwardly and inwardly tapered cylinders, for ease of ski movement.

As seen in FIGS. 1 and 6, a conventional pre-heater plate 115 (previously discussed) is provided in each ski support 35, 36 directly in front of each roller 38, 39. Thus, the bottom of each ski is pre-heated before encountering rollers 38, 39. The outer coating of each roller 38, 39 is preferably of polyurethane and rotates in the heated wax bath in tank 112 and wax is picked up by each roller 38, 39 and applied to the bottom of each ski. As heretofore indicated, suitable trip switches may be provided for actuating the motors so that the waxing operating does not stop until both skis pass therethrough. The conventional ski brake of the ski would merely extend down on the side of each ski support 35, 36.

The skis then pass over the buffers 102 which finish off the waxed surfaces. The motor 103 may be a high speed motor to carry out such buffing and the skis then exit out of apparatus 10. The motors actuating the pulleys may be of the constant velocity type. The wheels 59 may be tapered cylinders, narrower at the bottom than at the top to create downward pressure on the skis. Any suitable dimensions for wheels 59 may be used, such as a top diameter of about 2 inches to 2 and ½ inches and a bottom diameter about 1 to 1 and ½ inches.

The four sets of wheel assemblies 53 are synchronized for rotation. As seen in FIGS. 1 and 6 downchute 114 is provided opening into tank 112 which, as seen, is divided into two elongated sections 117, 118 having roller 38, 39, respectively, rotating therein. Downchute 114 extends from a wax feed bin on framework 11 and is provided with valve 113 at the bottom opening into tank 112. A conventional heater 120 extends into the interior of bin 119. Hard pelletized wax is deposited in bin 119, heated by heater 120, and injected into tank 112. Valve 113 is a reed-type valve, as previously discussed, having a float associated therewith so that, as the level of hot melted wax rises in tank 112, it will shut off the valve 113 and thus stop the flow of hot wax therein until the level falls again. The immersion heaters in tank 112 keep the wax melted and hot. Downchute 114 may be insulated and the heaters may be thermostatically controlled.

Figure 7:
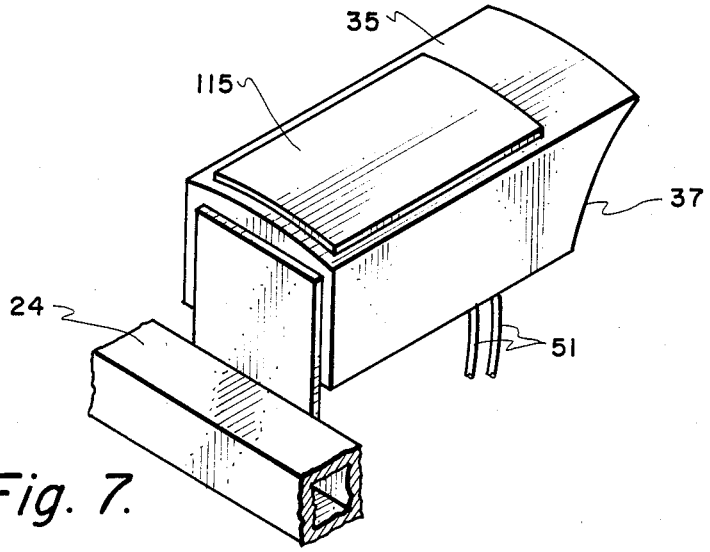
FIG. 7 is a particle perspective view of the ski support track.

As seen in FIG. 7, the upper surface of the ski support tracks 35, 36 (only track 35 shown) may be slightly concave to compensate for the slight curve or camber of the base of conventional skis. This eliminates the need for creating down pressure on the skis to hold it flat against tracks 35, 36 as the skis are being waxed.

Any suitable motors may be used, such as Dayton open fan cooled motors of any suitable horsepower.

Although the skis will be guided through apparatus 10 by engagement of wheels 59, it may be desired to provide additional ski guide means for maintaining the skis in proper alignment as they are transported along supports 35, 36. Thus, as shown in FIGS. 2, 4 and 6 a plurality of rotating rollers 121 are provided on each side of each support 35, 36 having a tapered cylindrical outer surface (tapering from top to bottom) adapted to bear against the sides of supports 35, 36 and engage the side edges of the skis 156 as they move along the supports. These rollers 121 may be of resilient material, Teflon coated, for example, and are journaled on axis 122 at the end of a swing arm 123 best seen in FIG. 6 which arm 123 may be resiliently biased, as by a spring 124 fixed at one end to framework 11 as seen in FIGS. 5 & 6. Since the rollers 121 are spring biased, the ski brakes merely move the rollers 121 out of their way against their spring bias as they move therepast. Another set of rollers 121, swing arm 123, and axis 122 can be seen at the end of lead-in track 160 best seen in FIGS. 2 and 4. As seen heretofore mentioned, the entire apparatus may be totally enclosed with hydraulically actuated front and rear doors and coin operated with suitable slots opening into the out of track supports 35, 36. All heated areas may be insulated. The transport time through apparatus 10 may be time by suitable timing switches to vary the cycle time through apparatus 10.

Figure 8:
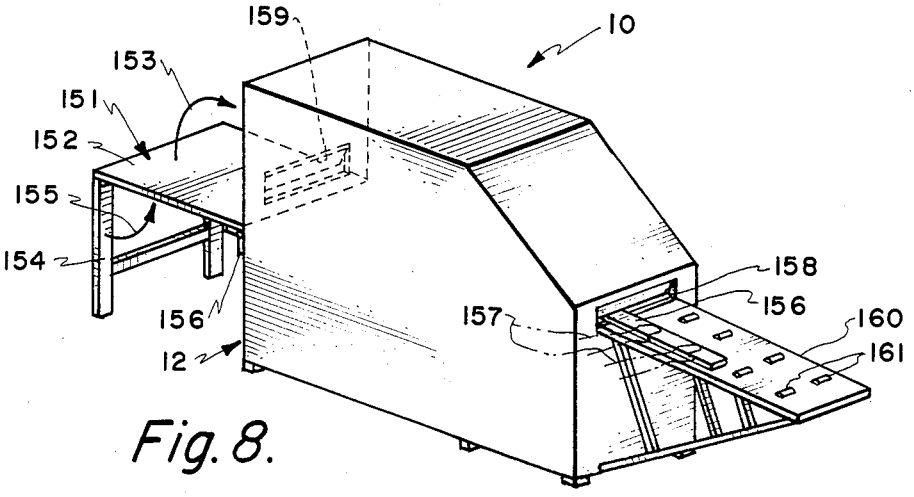
FIG. 8 is a perspective view of the device of this invention being utilized.

Turning now to FIG. 8 it is seen that the device 10 is shown in perspective with a ski 156 being fed by the hand and arm 157 of the user into the entry as front door 158 opens out of the way. Ski 156 rests upon rollers 161 of lead-in track 160. The rear door 159 is also seen.

Optional exit table 151 which may be hingedly or removably affixed by hinges 156 to the housing 12 has a table feed 152 which folds upward per arrow 153 toward housing 12 for storage and transportation. The H leg 154 folds upwardly in the direction of arrow 155 to attach on the underside of table bed 152 by fasteners not seen. Also the fasteners for securing the folded table 151 to the rear of housing 12 while conventional are also not seen.

Preferably the entry and exit doors 158, and 159 are hydraulic to prevent possible injury and tampering with the components on the interior of housing 12. These may be hydraulic as mentioned above, or electric and controlled by an electric eye.

It can be seen that there is disclosed a unique and novel ski waxing apparatus for applying heated wax to a ski bottom, remove excess wax, buff the waxed area and deliver the same in a quick and expeditious manner.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. Apparatus for waxing skis comprising:

(a) a bottom support framework which includes a frame supported by a plurality of upstanding corner supports, (b) an upper main housing mounted on said framework, said main housing comprising a box-like structure having a box-like frame mounted in a spaced relationship above the frame of the bottom support framework;

(c) at least one ski support track for supporting a ski thereon extending from said frame;

(d) guide and moving means on each side of said track adapted to engage the longitudinal edges of a ski on said track and guide said ski and move the same through said apparatus, and wherein said guide and moving means are on a vertical axis and are supported from above said track;

(e) hot ski wax applying means associated with said track for applying hot ski wax to the bottom of said ski;

(f) buffing means associated with said track for buffing the waxed bottom of a ski on said track after deposit of hot wax thereon.

2. In the apparatus of claim 1 wherein at least two ski support tracks are provided.

3. In the apparatus of claim 1 including excess wax removal means associated with said track after said applying means but before said buffing means for removing excess wax from the bottom of a ski on said track.

4. In the apparatus of claim 1 wherein said hot ski wax applying means includes a roller mounted in said track having a resilient outer surface, a hot wax holding tank below said roller, said roller being rotatable within said tank and having its resilient surface substantially flush with the upper surface of said track for rotating within said tank, picking up hot wax on said surface and applying the hot wax against the bottom of a ski on said track.

5. In the apparatus of claim 4 including heating means on said roller for heating said surface.

6. In the apparatus of claim 5 including heating means in said tank for heating the interior thereof.

7. In the apparatus of claim 5 including a wax supply bin on said apparatus opening into the interior of said tank for supplying wax thereto, and valve control means associated with said bin and the interior of said tank for selectively admitting wax therein.

8. In the apparatus of claim 7 including heating means associated with said bin for heating the interior thereof.

9. In the apparatus of claim 1 including resiliently biased ski guides mounted along the edges of said track, intermediate said guide and moving means, for engaging the edges of a ski on said track and maintaining said ski in alignment of said track.

10. In the apparatus of claim 1 including pre-heating means mounted in said track before said applying means for pre-heating the bottom of a ski on said track before said ski reaches said applying means.

11. In the apparatus of claim 1 wherein said buffing means includes a rotatable buffer having a flexible material on the outer surface thereof, said buffer being rotatable within said track and having its outer surface substantially flush with the upper surface of said track.

12. In the apparatus of claim 1 wherein said guide and moving means includes a plurality of spaced swing arms on each side of said track and at each end thereof with each of said swing arms having a rotatable wheel thereon at the ends of said arms leading into and out of said apparatus.

13. In the apparatus of claim 12 wherein said swing arms are resiliently biased in a direction toward said track.

14. In the apparatus of claim 12 wherein said wheels have a resilient outer surface.

15. In the apparatus of claim 12 including spacing means on said apparatus extending between swing arms on each side of said track for maintaining a predetermined spacing between adjacent swing arms on each side of said track.

16. In the apparatus of claim 12 wherein said wheels are tapered cylinders being wider at the top than at the bottom thereof.

17. In the apparatus of claim 12 wherein at least a pair of tracks are provided with swing arms on each side of each track at each end thereof, and first and second rotating means engaging all of said swing arms for rotating the wheels mounted thereon, said first rotating means rotating the wheels at the front of one of said tracks and the rear of the other of said tracks, the second rotating means rotating the wheels at the front of the other of said tracks and the rear of said one of said tracks.

18. In the apparatus of claim 17 wherein said first and second rotating means are rotated simultaneously.

19. In the apparatus of claim 1 wherein the upper surface of said track is slightly concave.

20. In the apparatus of claim 1 further including an exit table, mounted to the rear of said apparatus to receive a ski upon completion of the waxing operation.

* * * * *